United States Patent [19]

Suvak

[11] 4,012,171

[45] Mar. 15, 1977

[54] BLADE AND MOUNTING MEANS

[76] Inventor: Michael N. Suvak, 34900 Forest Lane, Solon, Ohio 44139

[22] Filed: Apr. 24, 1974

[21] Appl. No.: 463,570

[52] U.S. Cl. ..... 416/207; 416/209

[51] Int. Cl.[2] ..... F04D 29/36

[58] Field of Search ..... 416/204–207, 416/209, 248

[56] References Cited

UNITED STATES PATENTS

| | | | |
|---|---|---|---|
| 448,573 | 3/1891 | Laney | 403/370 X |
| 1,400,033 | 12/1921 | Dickey | 416/207 |
| 1,867,305 | 7/1932 | Brunk | 279/53 X |
| 2,075,335 | 3/1937 | Brown | 403/370 X |
| 2,664,961 | 1/1954 | Goede | 416/207 |
| 3,303,889 | 2/1967 | Bates | 416/204 UX |
| 3,323,710 | 6/1967 | Daly | 416/207 |
| 3,487,879 | 1/1970 | McCarthy et al. | 416/207 UX |
| 3,521,974 | 7/1970 | Zerlauth | 416/207 UX |

FOREIGN PATENTS OR APPLICATIONS

| | | | |
|---|---|---|---|
| 590,312 | 1/1960 | Canada | 416/207 |
| 724,793 | 9/1942 | Germany | 416/207 |
| 1,283,852 | 11/1968 | Germany | 416/207 |
| 627,829 | 8/1949 | United Kingdom | 416/204 |
| 903,792 | 8/1962 | United Kingdom | 416/207 |
| 952,785 | 3/1964 | United Kingdom | 416/207 |

*Primary Examiner*—Everette A. Powell, Jr.
*Attorney, Agent, or Firm*—Frank B. Robb

[57] ABSTRACT

There is disclosed a blade and mounting means particularly useful in the construction of axial flow compressors where blades of airfoil configuration are mounted in blade carriers so as to be removable and replaceable by manipulation of nuts on adapters arranged radially, which adapters include tubular bodies having frustoconical heads mounted in mating sockets in the carrier or carriers, the blades have portions positioned in the adapters and tightening of the nuts causes the adapters to grip the blades and fix them in adjusted positions, a seal to reduce losses being formed on the blades for use in those cases where such losses may be critical.

4 Claims, 6 Drawing Figures

BLADE AND MOUNTING MEANS

OBJECTS OF THE INVENTION

It is a principal object of the invention to provide a blade for use in axial flow compressors or the like, in which an airfoil blade is provided which in the usual case includes a threaded stem, whereby the blade may be mounted in a blade carrier, in this case the threaded stem being eliminated and substituted therefore, means to make the blade replaceable and manufactureable much more quickly and with considerably fewer losses and at less cost than heretofore has been the case.

A further object of the invention is to provide mounting means for the blades previously described, wherein an adapter or adapters for each blade are mounted or positioned in blade carriers so as to mount portions of the blade therein and and by manipulation of certain instrumentalities positively fix the blades in position with regard to the carrier and to prevent the same from being removed therefrom without manipulation of said instrumentalities.

Another object of the invention is to provide a novel adapter which is positioned in a socket, there being one for each blade, which socket may be made of other material than the blade material and reuseable, at the same time providing gripping action for the portion of the blade received within the adapter to maintain the blade or blades in adjusted position in the carrier whether the same be a rotor or a stator.

Another object of the invention is to provide an arrangement whereby the blades are made in much more uniform section as to thickness so that manufacture thereof may be effected with consequent decreased losses by reason of the uniformity and machining of such blades be reduced to a minimum if any at all is required.

A further object of the invention is to provide a sealing arrangement, which is cast integrally with the blade and upon manipulation of the instrumentalities for maintaining the blade in position, caused to be crushed so as to engage the surface of the blade carrier and prevent air loss at the root edges of such blades if such losses are critical in the construction of compressor under consideration.

Other and further objects of the invention will be understood from a consideration of the specification appended hereto and disclosed in the drawing wherein.

DESCRIPTION OF THE INVENTION

Figure 1:
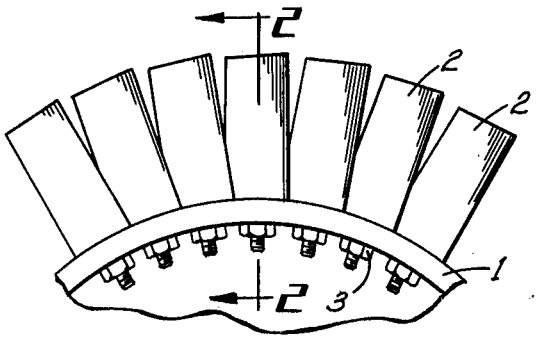
FIG. 1 is a fragmentary view showing a portion of a blade carrier, in this instance the rotor, as having blades supported thereon in the usual manner, in this instance however such blades being supported by the mounting means provided.

As suggested in FIG. 1, the usual blade carrier which for the purpose hereof is shown as a generally cylindrical member is designated 1, in an axial flow compressor, in this instance a portion of the rotor, having a series of blades 2 radially mounted thereon and fastened thereto by nuts such as 3 attached to the adapters to be further and more specifically described hereinafter.

Figure 4:
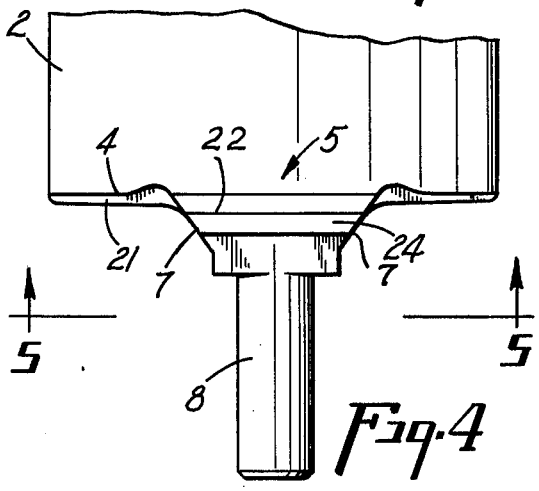
FIG. 4 is a fragmentary view of the lower portion of a blade showing the root edge and shank and stem thereof made in accordance with this invention.
Figure 5:
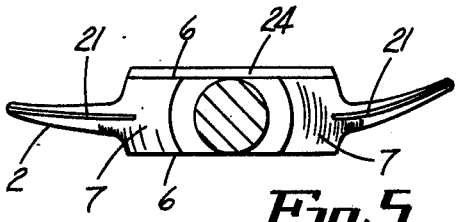
FIG. 5 is a view taken about on the line 5—5 of FIG. 4 looking in the direction of the arrows.

At this point reference is made to FIG. 4 showing a typical blade lower end wherein the root edge generally designated 4, is integrally cast with a shank 5 which shank as indicated in FIG. 5 includes the planar surfaces 6 at opposite sides, and parallel which as viewed in FIG. 4 provide a shank in elevation which actually has segments 7 of a frusto-conical surface.

The planar surfaces 6 are spaced from one another about the thickness of the stem 8 which extends downwardly from the shank 5 and in this instance is shown as being a cylindrical member for purposes as will hereinafter appear.

Figure 3:
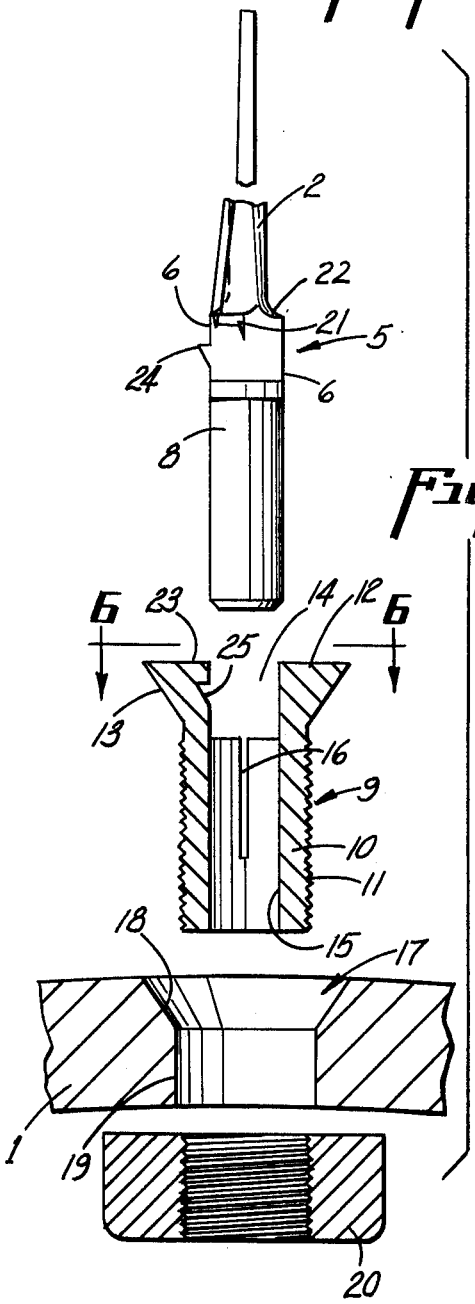
FIG. 3 is an exploded view showing the various elements of blade mounting in the circumstances and under the conditions described hereinafter, involving the blade, partly fragmentary, the adapter therefore, a section of the blade carrier and the nut or instrumentalities for maintaining the blade in position on such carrier.

Referring now to FIG. 3, with the blade 2 thereof having been described in some detail as reference to FIG. 4 will disclose, the blade is shown positioned above an adapter 9 which includes an adapter body 10 of tubular form, provided with threads 11 on the outer lower surface thereof and a head 12 at the upper end, the head 12 in turn having a frusto-conical surface 13 thereon.

The adapter 9 is further provided with a recess 14 diametrically arranged and of substantial depth as to receive therein the shank 5 of the blade 2.

With the frusto-conical surface segments 7 of the blade 2 in position with the stem 8 of the blade extending into the cylindrical opening 15 in the adapter 9, a continuous frusto-conical surface is provided in conjunction with the surface 13 of the head 12.

Figure 6:
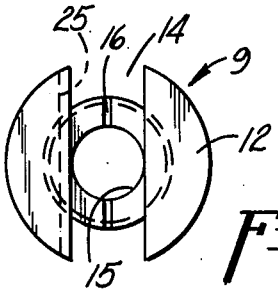
FIG. 6 is a view taken about on the line 6—6 of FIG. 3 looking in the direction of the arrows, being a top plan view of the adapter thereof.

In order to make the upper portion of the adapter 9 resilient enough to press upon and firmly engage with stem 8 of the blade 2, a diametral slot 16 is formed as likewise illustrated in FIG. 6 in relation to the recess 14 and head 12, whereby when the stem 8 of the blade 2 is positioned in the cylindrical opening 15, pressure exerted upon the opposite sides of the head 12 will cause the stem and shank of the blade 2 to be gripped by the head and body of the adapter 9.

In order to effect such gripping action, the blade carrier 1 is formed with a series of sockets 17 radially disposed, each including a frusto-conical section 18 and a cylindrical opening 19 contiguous therewith.

Figure 2:
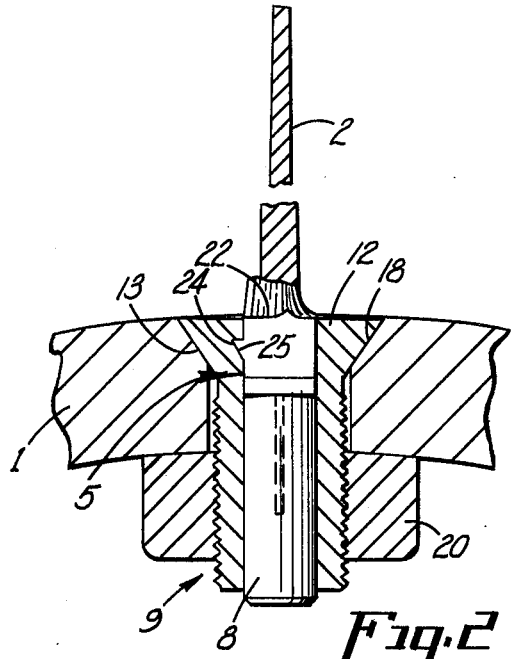
FIG. 2 is a fragmentary view in section, showing the various instrumentalities for mounting the blades in position on the carrier so as to maintain the same as mounted and adjusted.

It will thus be seen that when the adapter 9 is positioned as suggested in FIG. 2, the frusto-conical surface 18 in the carrier 1 will engage with the mating frusto-conical surface 13 on the head 12, and when a nut 20 is positioned on the threads 11, and drawn up so as to tightly pull the adapter 9 toward the center of the carrier 1, the surfaces of the recess 14 will engage with the planar surfaces 6 of the shank 5 and the tubular surface 15 will surround the stem 8 and tightly grip the same thereby, with the blade having been moved into the position where it is desired to remain set for the proper operation of the compressor of which it is a part.

It will be seen that the tighter the nuts 20 are drawn in each case, the greater the pressure of engagement of the respective mating portions of the adapter and socket particularly the frusto-conical sections thereof and necessarily the stem likewise so that the blade in each case will be suitably positioned and maintained in such position and yet removable as occasion may demand.

It is contemplated that the blades will usually be made of aluminum as die-castings, and that the adapter 9 may preferably be made of a suitable stainless steel or the like so that it will be usable and reusable in operation of the compressor.

Since under some circumstances there may be a possibility of leakage of air at the root edge 4 of the blade 2, it is within the purview of this invention to provide a seal, in this case a fin 21 which will be integrally cast with such root edge 4 extending to and in some cases desirably part way along the frusto-conical surfaces 7 of the shank 5.

This is shown both in FIGS. 4 and 5, and it will be understood that by manipulation of the nut when the blade is in proper position, this fin will be crushed and thus provide a seal of metal between the root edge of the blade or blades and the surface of the carrier.

It is noted that the blades are removable and adjustable within limits in accordance with desired specifications and construction of the blades and the formation of the blades is such as to provide a more nearly uniform section for die-casting successfully and without great losses in manufacturing.

At the juncture of the blade member 2 with the shank 5 there is a formation known as the platform, here designated 22, which if improperly formed or machined may cause turbulence and interfere with the efficiency of the compressor in the operation.

Since this area cannot always be perfectly machined for each rotor or stator, more generally here called a blade carrier as 1, the provision of the adapter 9 as disclosed is a particularly valuable improvement.

This is seen to be the case because the adapters 9 may be positioned in a blade carrier 1, in a condition where the final machining operation has not been effected on the surface 23 of the head 12. It is contemplated that each of the sockets 17 will be provided with an adapter 9, and thereafter final machining of the entire surface of the carrier will be effected whereby the platforms 23 of all the adapters will conform without objectionable interfering areas to the desired surface adjacent the same.

In view of the tremendous centrifugal forces which may be imposed on blades formed as herein described, it may be desirable to incorporate an interlocking construction to assure non-separation of the blade 1 from the adapter 9 and to that end a lock ridge 24, is shown as being cast in one of the planar surfaces 6, of the shank 5, which will interengage with a mating lock undercut 25 in one of the corresponding sides of the recess 14.

Thus when assembly of a blade 2 and adapter 9 is to be effected, the stem 8 will be inserted in opening 10 and ridge 24 caused to enter undercut 25 and the two parts thus maintained together.

By positioning the assembled parts in a socket 17, and manipulation of the nut 20 the parts are further fixed in position as heretofore explained.

It is entirely possible that interlocking would be desirable at both sides of the shank 5 and recess 14, though not shown as such.

I claim:

1. In blade and mounting means of the class described, in combination, a blade member, a shank thereon, a stem extending from the shank, an adapter to receive therein the stem and at least a portion of the shank aforesaid, said adapter including means to grip the stem and the shank portion upon application of pressure to the adapter, and instrumentalities including a nut to engage said adapter to apply such pressure when said adapter is mounted in a blade carrier, the adapter including a tubular body, having a head formed with a frusto-conical surface and a recess, threads are formed on the exterior of the body, a diametral slot extends across the adapter body in alignment with the recess, said slot extending axially along the adapter body, the nut is engaged with the threads, and the interior of the body is formed to receive the stem of the blade member to grip the same in the body as the nut is tightened on the threads when the adapter is in position on the blade carrier, the said shank enclosed portions conform to the frusto-conical surface on the head of the adapter, the blade member includes an edge extending outwardly beyond the shank aforesaid to overlie a surface of such blade carrier, a thin fin is formed integrally with the edge of the blade to extend from the same near the said shank, said fin being crushed against such surface as to cause the edge to be sealed there against when the adapter is tightened by manipulation of the nut.

2. The combination as claimed in claim 1, wherein the fin extends along at least a portion of the shank.

3. The combination as claimed in claim 1, wherein the blade member is formed with a cylindrical stem connected to the shank which includes planar sides spaced from one another about the thickness of the stem, said shank having outwardly diverging ends conforming to frusto-conical sections of the socket of a blade carrier in which the adapter is seated whereby to provide sealed engagement thereof.

4. The combination as claimed in claim 1, wherein lock means are formed on the shank and head, to interengage, when the blade is positioned in the adapter and the pressure maintains said lock means in operative position.

* * * * *